US009679534B2

(12) United States Patent
Breazile et al.

(10) Patent No.: US 9,679,534 B2
(45) Date of Patent: Jun. 13, 2017

(54) EMISSION UNIT BRIGHTNESS ADJUSTMENT

(71) Applicant: Microsoft Technology Licensing, LLC, Redmond, WA (US)

(72) Inventors: Jon Breazile, Redmond, WA (US); Ricardo Lopez-Barquilla, Redmond, WA (US); Yi-Min Huang, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 161 days.

(21) Appl. No.: 14/622,500

(22) Filed: Feb. 13, 2015

(65) Prior Publication Data

US 2016/0240167 A1 Aug. 18, 2016

(51) Int. Cl.
*G09G 5/10* (2006.01)
*G09G 3/34* (2006.01)

(52) U.S. Cl.
CPC ..... *G09G 5/10* (2013.01); *G09G 3/3406* (2013.01); *G09G 2320/0653* (2013.01); *G09G 2360/141* (2013.01); *G09G 2360/144* (2013.01)

(58) Field of Classification Search
CPC ..... G09G 2360/144; G09G 2360/141; G09G 2320/0653
See application file for complete search history.

(56) References Cited

U.S. PATENT DOCUMENTS 8,044,922 B1 10/2011 Lew et al.
8,169,450 B2 5/2012 Santo et al.
8,411,020 B2 4/2013 Yeh
8,493,370 B2 7/2013 Gettemy
8,508,465 B2 8/2013 Broga et al.
(Continued)

FOREIGN PATENT DOCUMENTS

EP 2492905 A1 8/2012
WO 03015066 A2 2/2003
WO 2014010949 A1 1/2014

OTHER PUBLICATIONS

Apple, Inc., Brightness Slider, Jun. 5, 2012, 2 pages, https://itunes.apple.com/gb/app/brightness-slider/id456624497?mt=12.
(Continued)

*Primary Examiner* — Shaheda Abdin
(74) *Attorney, Agent, or Firm* — Lempia Summerfield Katz LLC

(57) ABSTRACT

An electronic device includes a display including an emission unit, a light sensor configured to generate a signal indicative of ambient light level, a memory in which filtering instructions and emission control instructions are stored, and a processor configured to implement the filtering instructions to generate at least one filtered representation of the ambient light level in accordance with the signal. The processor is further configured to implement the emission control instructions to determine whether the ambient light level is increasing or decreasing, and to generate a control signal that, based on the at least one filtered representation, increases a brightness level of the emission unit at a first rate if the ambient light level is increasing and that decreases the brightness level at a second rate if the ambient light level is decreasing. The first rate is greater than the second rate.

20 Claims, 3 Drawing Sheets

(56) References Cited

U.S. PATENT DOCUMENTS

| | | | | |
|---|---|---|---|---|
| 2005/0041139 | A1 | 2/2005 | Lowles | |
| 2005/0190142 | A1 | 9/2005 | Ferguson | |
| 2008/0055519 | A1* | 3/2008 | Battersby | G09G 3/3648 349/68 |
| 2012/0019152 | A1 | 1/2012 | Barnhoefer et al. | |
| 2012/0218282 | A1 | 8/2012 | Choboter et al. | |
| 2013/0021308 | A1 | 1/2013 | Ge | |
| 2013/0328842 | A1* | 12/2013 | Barnhoefer | G09G 3/3406 345/207 |

OTHER PUBLICATIONS

Ilya Veygman, "A Simple Implementation of LCD Brightness Control Using the MAX44009 Ambient-Light Sensor", Application Note 4913, Maxim Integrated Products, Inc., Jan. 21, 2011, 12 pages.

"International Search Report & Written Opinion Issued in PCT Application No. PCT/US2016/016239", Mailed Date: May 11, 2016, 17 Pages.

"Written Opinion of the International Preliminary Examining Authority" issued in PCT Application No. PCT/US2015/016239, Mailed Date: Dec. 15, 2016, 10 Pages.

* cited by examiner

EMISSION UNIT BRIGHTNESS ADJUSTMENT

DESCRIPTION OF THE DRAWING FIGURES

For a more complete understanding of the disclosure, reference is made to the following detailed description and accompanying drawing figures, in which like reference numerals may be used to identify like elements in the figures.

Figure 1:
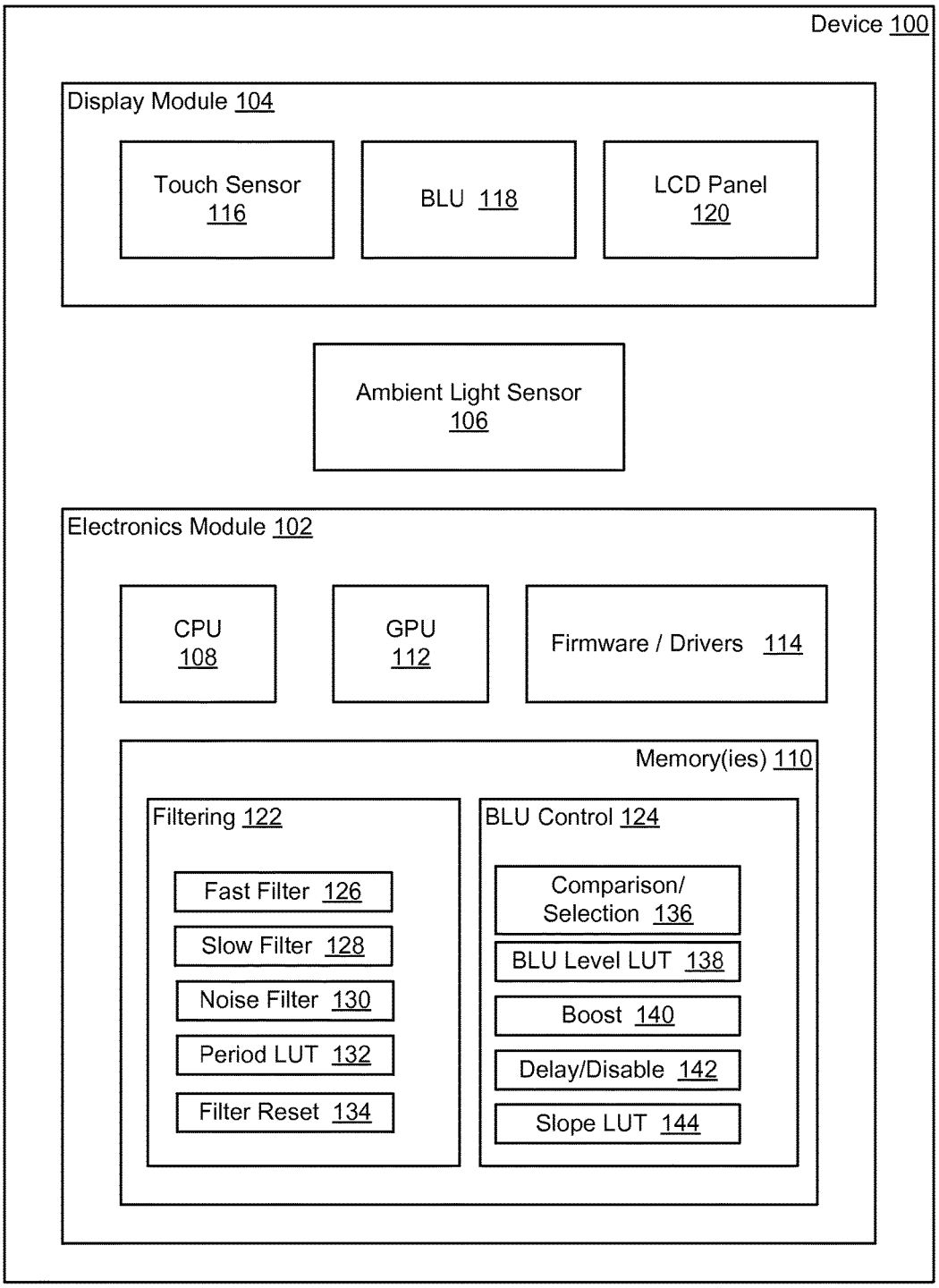
FIG. 1 is a block diagram of an electronic device with emission unit brightness adjustment in accordance with one example.

While the disclosed devices, methods, and systems are susceptible of embodiments in various forms, specific embodiments are illustrated in the drawing (and are hereafter described), with the understanding that the disclosure is intended to be illustrative, and is not intended to limit the invention to the specific embodiments described and illustrated herein.

DETAILED DESCRIPTION

A display of an electronic device has an emission unit, such as a backlight unit to illuminate a liquid crystal display (LCD) panel or an organic light emitting diode (OLED) panel that emits light. The electronic device also has one or more ambient light sensors to detect the ambient light level. The ambient light level is used to control the brightness level of the emission unit, e.g., backlight unit (BLU). An ambient light level may be mapped to a desired BLU brightness level (or target level). But rather than immediately adjusting to the target level, the BLU brightness level is dynamically controlled in accordance with different lighting scenarios. A number of different scenarios may be defined, each providing a different, customized BLU brightness level adjustment experience. Such customized, dynamic control reduces or eliminates user experiences that are distracting or disturbing to the user because the adjustments in backlight brightness level occur too abruptly.

The speed or rate at which the brightness level is adjusted depends upon the direction in which the ambient light level is trending. If the ambient light level is increasing (i.e., a positive or upward trend), the brightness level of the backlight unit is increased at a rate higher than the rate at which the brightness level is decreased when the ambient light level is decreasing (i.e., a negative or downward trend). The rate of the backlight adjustment may thus be customized for darkening trends and brightening trends. The rates at which the BLU brightness level are increased or decreased may be adjusted or established by selecting or otherwise adjusting a sampling period of one or more filters used to process data or other signals generated by the light sensor(s).

The adjustment rates may also be established in accordance with the magnitude of the ambient light level. For instance, the rate at which the BLU brightness level is increased may differ as a function of the ambient light level. The rate may increase as the ambient light level increases. Conversely, the rate at which the brightness level is decreased may decrease as the ambient light level decreases. In some examples, the adjustment rates are established in accordance with ranges of ambient light levels.

The user experience provided by the electronic devices may improve through these adjustments and/or other aspects of the BLU brightness control. For instance, a slower backlight adjustment may be appropriate in scenarios in which the ambient light levels are decreasing and/or low, because it takes a longer time for the user's eyes to adjust to a darker environment. The slower adjustment may thus minimize or avoid perceivable jumps in BLU brightness levels. Such jumps may be jarring or otherwise disturbing for the user. When transitioning to a bright environment and/or at high light levels, backlight levels may transition to a bright level more quickly because the eyes adjust more quickly in that direction. A transition to a bright environment may thus warrant a quicker adjustment than a transition to a dark environment.

The brightness adjustment rates may be optimized for specific lighting scenarios. For instance, the rate at which the BLU brightness level is increased may be boosted under certain, low-light circumstances. A quick transition to a bright environment, such as turning on an intense indoor light in a dark room, may warrant a quicker adjustment than otherwise provided via the trend-based dynamic control. The adjustment rate may be boosted from the rate that would otherwise be called for given the ambient light level and the trend. This dark-to-bright adjustment boost feature may accordingly override the other dynamic BLU brightness level control techniques to quickly bring the BLU brightness level to an appropriate level. When bright events occur, the user experience may thus benefit from a more immediate brightening of the screen.

In some cases, adjustments may be delayed to prevent the BLU level from adjusting too quickly in dark (e.g., very dark) environments. The delay may be implemented through hysteresis or other techniques. When ambient light levels are sufficiently dark, the brightness level may be adjusted infrequently and/or slowly so as to be imperceptible (or relatively imperceptible) to the user while transitioning to the appropriate brightness. In these scenarios, a hysteresis or other delay in the backlight adjustment may result in deviation from the adjustment rates established given the trend and magnitude of the ambient light level. The hysteresis or other delay may decrease as the environment brightens. For example, a configurable hysteresis slope or other curve may be defined to gradually decrease (e.g., linearly) the delay as the environment brightens.

Additional, fewer, or alternative specialized adjustments may be specified for various lighting scenarios, each adjustment being defined to optimize or provide a different backlight adjustment experience. In some cases, the dynamic brightness adjustments may be combined with other brightness control techniques. For instance, the dynamic brightness adjustments may be combined with procedures that support manual user control of the BLU brightness level. Rather than take full control of the BLU brightness level, the techniques may allow the user to override the brightness adjustment. For example, the user may be presented with a BLU brightness slider or other override control tool to allow the user to directly establish or otherwise influence the brightness level. In some cases, the backlight slider override biases the brightness levels up or down, e.g., from a minimum of 0% up to 100%.

Additional or alternative overrides may be included. For example, the dynamic brightness adjustments may be overridden or otherwise modified in connection with touchscreen and other touch-sensitive displays. For example, the brightness level adjustments may be suspended during touch events, such as when a stylus is detected by the touchscreen.

Any one or more of the brightness adjustment or control features described herein may be provided in a user-configurable manner. User configuration of the features may cause the display to react quicker or slower to changes in the ambient light level. Those users that prefer a quicker or slower reaction may thus be accommodated. The features may be adjustable or configurable via a control panel or other user interface. Examples of configurable parameters or settings include the sampling period of a filter, the speed at which brightness adjustments are boosted, the extent of a hysteresis or other delay, and the sampling rate of an ambient light sensor. Additional or alternative parameters, settings or features may be adjustable by a user or otherwise configurable.

Although described in connection with electronic devices having backlight units, touchscreens and other display-related components, the dynamic brightness level adjustment techniques may be used in connection with a wide variety of displays and electronic devices. For instance, the electronic devices may include one or more organic light emitting diode (OLED) devices as an emission unit of the display. The display may thus, in some cases, not include a liquid crystal display (LCD) panel. The electronic devices may also not include a touchscreen or other touch-sensitive surface. The size and form factor of the display may also vary considerably. Devices may range from wearable or handheld devices to televisions or other wall-mounted displays or other large-scale devices. The display may be flexible. The composition and other characteristics of the backlight unit and display module of the electronic devices may also vary accordingly.

FIG. 1 shows an exemplary electronic device 100 having ambient-based brightness level adjustment. The electronic device 100 has a number of components arranged in, or otherwise associated with, an electronics module (or subsystem) 102 and a display module (or subsystem) 104. The electronic device 100 may include additional, fewer, or alternative modules, subsystems, or components. For example, the display module 104 may be integrated with the electronics module 102 and/or other components of the electronic device 100 to a varying extent. For instance, the electronics module 102 and/or the display module 104 may include a graphics subsystem of the electronic device 100. Any number of display modules or systems may be included.

The electronic device 100 includes an ambient light sensor 106 configured to generate a signal indicative of the level of the ambient light. The ambient light sensor 106 may be disposed on or along an outer surface of the electronic device 100 to capture light from the environment surrounding the electronic device 100. The ambient light sensor 106 may be disposed along a housing, cover, case, or other enclosure of the electronic device 100. The ambient light sensor 106 may include one or more light detectors or sensors. For example, the ambient light sensor 106 may include one or more photodiodes, charge-coupled device (CCD), or other light-sensitive elements or devices. The configuration, composition, construction, and/or other characteristics of the ambient light sensor(s) 106 may vary considerably.

The signal generated by the ambient light sensor 106 may be an analog or digital signal. In some cases, the ambient light sensor 106 includes an analog-to-digital converter to generate a digital signal. In other cases, the conversion from the analog domain to the digital domain is provided by other components, such as a processor or processing system-on-a-chip. The signal may include multiple signals, each signal being generated by a respective detector or sensor of the ambient light sensor 106. Alternatively, the signal may be representative of an average or other computation of the ambient light level detected by the multiple detectors or sensors of the ambient light sensor 106.

The device 100 includes a processor 108 and one or more memories 110. In this example, the processor 108 and the memories 110 are disposed in the electronics module 102. In other cases (e.g., a television), the processor 108 and the memories 110 may be disposed in the display module 104 or another module or subsystem. The processor 108 and the memories 110 may be directed to executing one or more applications implemented by the device 100. For example, the display module 104 may generate a user interface for an operating environment (e.g., an application environment) supported by the processor 108 and the memories 110. The processor 108 may be a general-purpose processor, such as a central processing unit (CPU), or any other processor or processing unit. Any number of such processors or processing units may be included.

In the example of FIG. 1, the electronics module 102 includes a graphics processing unit (GPU) 112 and firmware and/or drivers 114. The GPU 112 may be dedicated to graphics- or display-related functionality and/or provide general processing functionality. The GPU 112 may be integrated with the processor 108, the one or more of the memories 110, and/or the firmware 114 may be integrated as a system-on-a-chip (SoC) or application-specific integrated circuit (ASIC). Other components of the electronics module 102 may also be integrated.

The electronics module 102 may include additional, fewer, or alternative components. For example, the electronics module 102 may not include a dedicated graphics processor, and instead rely on the processor 108, such as a CPU or other general-purpose processor, to support the graphics-related functionality of the electronic device 100. The electronics module 102 may include additional (e.g., dedicated) memory (or memories) to support display-related processing.

In the example of FIG. 1, the display module 104 includes a touch sensor unit 116, a backlight unit (BLU) 118, and an LCD panel or unit 120. The construction, composition, configuration, and/or other characteristics of these units of the display module 104 may vary considerably. For instance, the touch sensor unit 116 may be a capacitive, resistive, or optical touch sensor unit, but other touch sensing technologies may be used, such as various acoustic touch sensing technologies. The touch sensor unit 116 may be configured for proximity sensing such that the term "touch" includes both contact and non-contact events. Different types of backlight technologies may be used in the BLU 118. The BLU 118 may include edge-mounted light sources (e.g., light emitting diode (LED) devices) and/or planar emission devices. The LCD panel 120 may be configured as an in-plane switched (IPS) display or a plane-to-line switched (PLS) display, but other types of LCD technologies may be used, such as vertical alignment (VA) displays. Additional, fewer, or alternative display components may be provided. For instance, the display module 104 does not include the touch sensor unit 116 and/or the LCD unit 120.

The display module 104 may include different types of emission units. For example, in some cases, the display module 104 includes one or more OLED devices as the emission unit. The OLED device(s) may act as the BLU 118 (e.g., an OLED backlight), or replace both the BLU 118 and the LCD unit 120 (e.g., an OLED display). Nonetheless, the brightness level adjusted via the techniques described herein may be referred to as a BLU brightness level for ease in description. In cases in which OLED devices are used, controlling the brightness level may involve controlling the OLED devices on a pixel-by-pixel basis. The brightness levels of the pixels may or may not be adjusted uniformly.

The firmware 114 may include instructions for operating the ambient light sensor(s) 106. Such instructions may be directed to driving the ambient light sensor(s) 106 and/or processing outputs generated by the ambient light sensor(s) 106. For example, the firmware 114 may include instructions for input operations, such as analog-to-digital conversion of sensor signals, and noise and other filtering, and/or for output operations, such as generating control signals for the BLU unit 118 and the LCD panel 120. Additional, fewer, or alternative components of the electronic device 100 may be considered to be part of the memory (or memories) 110. For example, one or both of the processor 108 and the GPU 112 may include on-board memory units in which instructions are stored.

Stored in the memory (or memories) 110 are a number of instruction sets. In this example, filtering instructions 122 and backlight control instructions 124 are stored in the memory (or memories) 110. The instructions 122, 124 may include one or more instruction sets. Each instruction set includes computer-executable instructions. In the example of FIG. 1, the instructions are executed or implemented by the processor 108 and/or the GPU 112. The instructions sets may be arranged in or as modules or other blocks or components.

The processor 108 and/or another processor is configured to implement the filtering instructions 122 to generate at least one filtered representation of the ambient light level in accordance with the signal generated by the ambient light sensor 106. In the example of FIG. 1, three filtered representations are provided. Each filtered representation may be produced through low-pass filtering. One or more of the filtered representation(s) may be used to remove noise and other high-frequency components of the ambient light signals from the sensor 106. In some examples, each filtered representation is generated in accordance with an infinite impulse response (IIR) filter. Other types of low-pass filters may be used, including, for instance, finite impulse response (FIR) filters, moving average filters (e.g., simple or weighted moving average filters, such as an exponentially weighted moving average), and moving median filters. Multiple, different filtered representations may be generated to support the BLU brightness level adjustments. The filtered representations may thus be provided for purposes other than noise removal and other smoothing, as described below.

The processor 108 and/or another processor is configured to implement the backlight control instructions 124 to determine whether the ambient light level is increasing or decreasing. The backlight control instructions 124 may thus direct the processor 108 to determine the direction in which the ambient light level is trending, i.e., either brightening or darkening. The direction in which the ambient light level is trending may be referred to herein as the "ambient trend."

The backlight control instructions 124 may determine the ambient trend through analysis of the filtered representation(s). In some cases, multiple filtered representations are compared, as described below. Other types of analyses may be used to determine the ambient trend. For example, other techniques may involve a different comparison involving, for instance, past values of one or more filtered representations.

The ambient trend is used to generate a control signal for the BLU unit 118. The ambient trend may establish the rate at which the BLU brightness level adjusts. Different rates may thus be established based on whether the ambient light level is increasing or decreasing. The processor 108 and/or another processor is configured to implement the backlight control instructions 124 to generate the control signal. The control signal increases a brightness level of the backlight unit at a first rate if the ambient light level is increasing. The control signal decreases the brightness level at a second rate if the ambient light level is decreasing. The first rate is greater than the second rate. The BLU brightness level may thus be adjusted at appropriate rates given the ability of the viewer's eyes to adjust.

In the example of FIG. 1, multiple filtered representations of the ambient light level are generated in accordance with the signal from the ambient light sensor 106. The filtered representations are based on filters of varying speeds. In this case, the filtering instructions 122 direct the processor 108 to implement a fast filter 126, a slow filter 128, and a noise filter 130. Each filter 126, 128, 130 may be defined via the filtering instructions 122. The speed of the filters 126, 128, 130 may be indicative of the speed at which the output of the filters responds to a change in the input (e.g., the sensor signal). The varying speeds may be established by varying the length (or width) of the sampling window or period of the filter. For example, the fast filter 126 has a shorter sampling period than the slow filter 128. The relative differences in the sampling periods may thus lead the filter 128 to be considered a slow (or slower) filter, and the filter 126 to be considered a fast (or faster) filter.

The adjustment rates for the BLU brightness level may be based on the fast filter 126 and the slow filter 128. The differences in the sampling periods of the filters 126, 128 may thus be used to establish or select the rate at which the brightness level is adjusted. The filtered representation generated by the slow filter 128 has a longer sampling period and, thus, adjusts the brightness level at a slower rate. The filtered representation generated by the fast filter 126 has a shorter sampling period and, thus, adjusts the brightness level at a higher rate.

The BLU control instructions 124 direct the processor 108 to generate the control signal based on the direction in which the ambient light level is trending, i.e., the ambient trend. In the example of FIG. 1, the control signal either increases the brightness level in accordance with the filtered representation of the fast filter 126 or decreases the brightness level in accordance with the filtered representation of the slow filter 128. If the ambient trend is positive, the brightness level is increased in accordance with the fast filter 126. If the ambient trend is negative, the brightness level is decreased in accordance with the slow filter 128.

The sampling periods of the fast and slow filters 126, 128 may also vary based on the magnitude of the ambient light level. For example, the sampling periods may be defined as a function (or multiple functions) of the ambient light level. The filtering instructions 122 may thus direct the processor 108 to adjust the BLU brightness adjustment rates based both on the magnitude and the trend of the ambient light level. Generally, the sampling periods of the fast and slow filters 126, 128 may increase as the ambient light level decreases. In the example of FIG. 1, the filtering instructions 122 include a filter sampling period look-up table 132 (or "period LUT") that specifies the sampling periods for the fast and slow filters 126, 128 based on the ambient light level. In some cases, the filter sampling period LUT 132 may specify sampling periods for a number of ranges of the ambient light level. Alternatively or additionally, the sampling periods are specified as a function of the ambient light level.

In some cases, the period LUT 132 (or other data structure of the filtering instructions 122) defines or otherwise establishes first and second sets of rates for the brightness adjustments. One set of rates may be directed to adjustments when the ambient light level is increasing. The other set of rates may be directed to adjustments when the ambient light level is decreasing. In the example of FIG. 1, each set of rates specifies various sampling periods for the fast and slow filters 126, 128. The filtering instructions 122 may direct the processor 108 to select a respective rate from the sets based on the ambient light level.

One example of the sampling period look-up table 132 is set forth below in Table 1. Respective sets of sampling periods are specified for the fast and slow filters 126, 128. In this example, the ambient light sensor 106 provides the signal indicative of the ambient light level every 100 milliseconds. The sampling periods (or adjustment speeds) of the filters 126, 128 are expressed in milliseconds (ms) as well. For example, the sampling period of the slow filter is 30,000 ms when the ambient light level falls within the range of 0-10 LUX. A sampling period of 30,000 ms corresponds with a sampling period equal to 300 samples in case in which the ambient light level is reported by the ambient light sensor 106 every 100 ms.

TABLE 1

| Ambient Light Level (LUX) | BLU Level | Slow Filter (ms) | Fast Filter (ms) |
|---|---|---|---|
| 0-10 | 0-10% | 30000 | 20000 |
| 11-40 | 11-40% | 24000 | 12000 |
| 41-100 | 41-45% | 12000 | 6000 |
| 101-200 | 46-53% | 9000 | 5000 |
| 201-400 | 54-60% | 7000 | 4000 |
| 401-1500 | 61-100% | 5000 | 3000 |

Table 1 also shows the desired, or target, BLU brightness levels corresponding with the ambient light levels. In this example, a range of target BLU brightness levels is defined for each range of ambient light levels. A specific BLU brightness level may be selected within each range of BLU brightness levels by mapping (e.g., linearly mapping) the range of ambient light levels to the corresponding range of BLU brightness levels. Thus, in some cases, the sampling period look-up table 132 may also provide BLU brightness levels to be used by the control instructions 124 to generate the control signal. In other cases, the target BLU brightness levels are provided by a separate look-up table (see, e.g., the BLU level LUT 138 of FIG. 1).

Any of the parameters set forth in Table 1 may be user-configurable or otherwise adjustable settings. For instance, a user interface may be provided to allow a user to customize one or more of the parameters. A user may, thus, in one example, lower the sampling periods of the slow filter to achieve a slower dimming.

One or more of the filtered representations of the ambient light level may be reset during operation under certain lighting scenarios. In the example of FIG. 1, the filtering instructions 122 include filter reset instructions 134 to reset the filtered representation provided by the slow filter 128. The filter reset instructions 134 may direct the processor 108 to reset the filtered representation of the slow filter 128 to the filtered representation (or value) provided by the fast filter 126. The slow filter 128 may be reset when the ambient light level is increasing, e.g., when the lighting scenario calls for the fast filter 126. The reset may occur at the end of each iteration of the implementation of the filtering instructions 122. In that way, the filtered representations provided by the fast and slow filters 126, 128 may be compared or otherwise processed before the reset occurs.

Without the reset, the value of the slow filter 128 may be offset from the value of the fast filter 126 when the lighting scenario eventually calls for the slow filter 128. The reset may thus be useful to avoid a jump in the BLU brightness level at that future point in time in which the slow filter 128 is determinative of the BLU brightness level. The reset may be especially useful in lighting scenarios in which the ambient trend is frequently oscillating between darkening and brightening.

In some cases, the ambient trend is determined based on a comparison of two or more of the filtered representations. In the example of FIG. 1, the BLU control instructions 124 include comparison/selection instructions 136 that direct the processor 108 to determine whether the ambient light level is increasing or decreasing based on a comparison of the filtered representations provided by the fast and slow filters 126, 128. A greater filtered representation from the fast filter 126 relative to the filtered representation of the slow filter 128 is indicative of a brightening ambient light level, i.e., an increasing or positive ambient trend. The converse, a higher filtered representation from the slow filter 128, is indicative of a darkening ambient light level, i.e., a decreasing or negative ambient trend. In other cases, the comparison may involve a different combination of the filtered representations provided by the filters 126, 128, 130.

Once the ambient trend is determined, one of the filtered representations may be selected to generate the BLU control signal. In the example of FIG. 1, the comparison/selection instructions 136 implement the selection. The filtered representation of the fast filter 126 is selected when the ambient trend is positive. The filtered representation of the slow filter 128 is selected when the ambient trend is negative.

The control instructions 124 may then direct the processor 108 to determine the BLU brightness level that corresponds with the value of the selected filtered representation. Data and/or other instructions may be stored in the memory (or memories) 110 to map the filtered representation to a corresponding BLU brightness level. In the example of FIG. 1, the control instructions 124 include a BLU brightness level look-up table 138 (or BLU level LUT). The BLU level LUT 138 may specify the BLU brightness levels directly and/or indirectly. In one example of an indirect specification, respective ranges of BLU brightness levels are correlated with respective ranges of the ambient light levels presented by the filters 126, 128. The BLU brightness level for a specific ambient light level may then be determined through interpolation from the endpoints of the ranges. An example is presented above in Table 1. The BLU level LUT 138 may or may not be integrated with the sampling period LUT 132 or any other data structure stored in the memory (or memories) 110.

The ambient trend may be determined in other ways. The comparison/selection instructions 136 may implement one or more other comparisons. For example, the current value of one of the filtered representations of the ambient light level may be compared with a previous value of the filtered representation. To this end, the memory (or memories) 110 may include a buffer in which the previous value is stored. In some cases, the filtering instructions 122 may be define a filter for this purpose. In other cases, one of the other filters 126, 128, 130 may be used, such as the noise filter 130. In still other cases, the previous values of multiple filters may be used to determine the ambient trend.

The BLU control instructions 124 may include a number of instruction sets that direct the processor 108 to depart or deviate from the BLU brightness level determined solely via the filtered representations. The instruction sets may be directed to accelerating, decelerating, or otherwise delaying or disabling the adjustments to the BLU brightness level. These departures or deviations may be implemented under certain circumstances. Respective ambient light level and/or other thresholds may be used to enable the departure or deviation.

In the example of FIG. 1, the BLU control instructions 124 include a boost instruction set 140 and a delay/disable instruction set 142. The boost instruction set 140 directs the processor 108 to accelerate the adjustments beyond those called for via the selected filtered representation. For example, the boost instruction set 140 may boost the filtered representation of one of the filters 126, 128 in a manner that decreases the difference between two of the filtered representations. The rate at which the BLU brightness level is adjusted may thus be boosted by increasing the filtered representation with each iterative implementation of the control instructions 124.

In some cases, the boost instruction set 140 is implemented when the ambient light level resides below a threshold level. The threshold level may limit application of the boost instruction set 140 to low ambient light levels, such as those below 100 LUX. One or more of the filtered representations may be involved in the threshold comparison. In one example, the boost is applied when the filtered representations of both the slow filter 128 and the noise filter 130 are below the threshold. In other cases, only one of those filtered representations may be used.

The filtered representations may also be used to determine the magnitude of the boost. In some cases, determining the boost magnitude includes determining the difference between the filtered representations of the fast filter 126 (or the slow filter 128) and the noise filter 130. The filtered representation of the fast filter 126 may then be boosted by a fractional amount of the difference. For example, the boost may be equal to one-eighth or 12.5% of the difference. The filtered representation of the fast filter 126 (or the slow filter 128) then catches up to the filtered representation of the noise filter 130 in eight iterations (or eight samples), if all else (e.g., each of the filtered representations) remains the same.

The delay/disable instruction set 142 may direct the processor 108 to delay or prevent a change in the brightness level if the brightness level is below a threshold level. Such delay may be considered a hysteresis delay. Adjustments may be delayed for a number of iterations of the procedure. For example, the adjustment may be delayed for a number of samples of the ambient light level to prevent the BLU brightness level from reacting improperly in low light conditions. The length of the delay may vary. For instance, the number of iterations or samples of the delay may vary. In some cases, the extent to which the adjustment is delayed (e.g., the length of the delay) varies with the BLU brightness level. In the example of FIG. 1, the length of the delay is specified via a hysteresis slope look-up table 144. The look-up table 144 may establish a hysteresis delay over a range of BLU brightness levels. In some cases, the hysteresis delay is a linear function of the BLU brightness levels. Other functions or relationships of the BLU brightness level may be used. Further details regarding an exemplary hysteresis delay instruction set are provided in connection with FIG. 3.

The delay/disable instruction set 142 may disable or prevent brightness level adjustments in additional or alternative circumstances. For example, adjustments may be disabled or prevented while the touch sensor unit 116 detects the presence of a stylus or pen.

One or more of the instruction sets of the control instructions 124 may be configured to take precedence over certain other instructions of the control instructions 124. For example, the boost instructions 140 may direct, under certain conditions, the processor 108 to not implement (or otherwise disregard) the delay/disable instruction set 142 (or a portion thereof). In some cases, a hysteresis delay procedure is not implemented while the boost procedure is active. The boost procedure thus overrides the hysteresis delay procedure in such cases. Additional or alternative overrides may be used. The conditions under which an override occurs may involve one or more threshold comparisons in connection with one or more of the filtered representations.

In the example of FIG. 1, the filtering instructions 122 include instructions to define the noise filter 130 to support the decision as to whether to depart or deviate from the BLU brightness level derived from the fast and slow filters 126, 128. The noise filter 130 directs the processor 108 to generate a noise-filtered representation of the ambient light level in accordance with the signal from the ambient light sensor 106. The noise filter 130 may have a shorter sampling period than both the fast and slow filters 126, 128. For example, the sampling period may be about 2000 ms (e.g., 20 samples when sampling every 100 ms), but other sampling periods may be used.

The noise filter 130 may be configured to provide a filtered representation that closely tracks the ambient light level while smoothing out spikes in the ambient light level due to noise. For instance, the noise filter 130 may be configured to remove spikes or other noise in the sensor output. The noise-filtered representation is thus more responsive to changes in the ambient light level than the filtered representations provided by the fast and slow filters 126, 128.

The sampling period of the noise filter 130 may be a configurable parameter. For example, a value for the parameter may be selected by a user during operation of the device 100 and/or during an initial calibration or setup procedure. The conditions under which the boost instructions 140 are implemented may thus be optimized or customized.

The noise filter 130 may be implemented to support one of the instruction sets configured to depart or deviate from sole reliance on one of the filtered representations of ambient light level. In some cases, the boost instructions 140 may direct the processor 108 to boost the adjustment rate (e.g., implement the boost instruction set 140) if a difference between the noise-filtered representation and another filtered representation exceeds a threshold. For example, because the noise filter 130 tracks the ambient light level more closely than the fast and slow filters 126, 128, the difference between the filtered representations from the noise filter 130 and either the fast or slow filter 126, 128 may be used to determine whether boosting the adjustments to the BLU brightness level is warranted. Further thresholds may be used to establish the conditions under which the boost instructions 140 are implemented. For example, the implementation of the boost instructions 140 may be triggered if both (i) the difference exceeds a threshold and (ii) the ambient light level (and/or the BLU brightness level) is below a threshold level. Boosting the BLU brightness level adjustment rate may thus only occur in low light conditions.

The amount of the boost may also be derived from the difference. For instance, the filtered representation of the fast and/or slow filter 126, 128 may be modified to remove the difference in a certain number, e.g., eight, iterations of the procedure. In some cases, the levels of both the fast filter 126 and the slow filter 128 are boosted via implementation of the boost instructions. Alternatively or additionally, such boosting of both levels may be achieved through a reset procedure, such as the procedure provided via implementation of the filter reset instructions 134. A boost over eight iterations corresponds with a change in the filtered representation of 12.5% of the difference from the filtered representation from the noise filter 130.

The boost instructions 140 may be configured for implementation only when the ambient light level is increasing. In other cases, the boost instructions 140 may be applicable for increasing and decreasing ambient light levels. In such cases, the boost may differ depending on whether the ambient light level is increasing or decreasing. In one example, the speed at which the brightness level is boosted may be lower for decreasing ambient light levels.

The number of filters (or filtered representations of the ambient light level) may vary. For instance, in other cases, the filtering instructions 122 may not include the noise filter 130. Alternatively or additionally, the filtering instructions 122 may define multiple fast filters and multiple slow filters.

The filtered representation(s) may be used to control the BLU brightness level in ways other than through multiple filters used to support multiple desired brightness levels. For instance, in some cases, a single filtered representation may be used to determine a desired or target brightness level. Two rates, a slower rate and a faster rate, of adjustment may be predetermined or established in accordance with another parameter, such as the current (or most recent) ambient light level.

Figure 2:
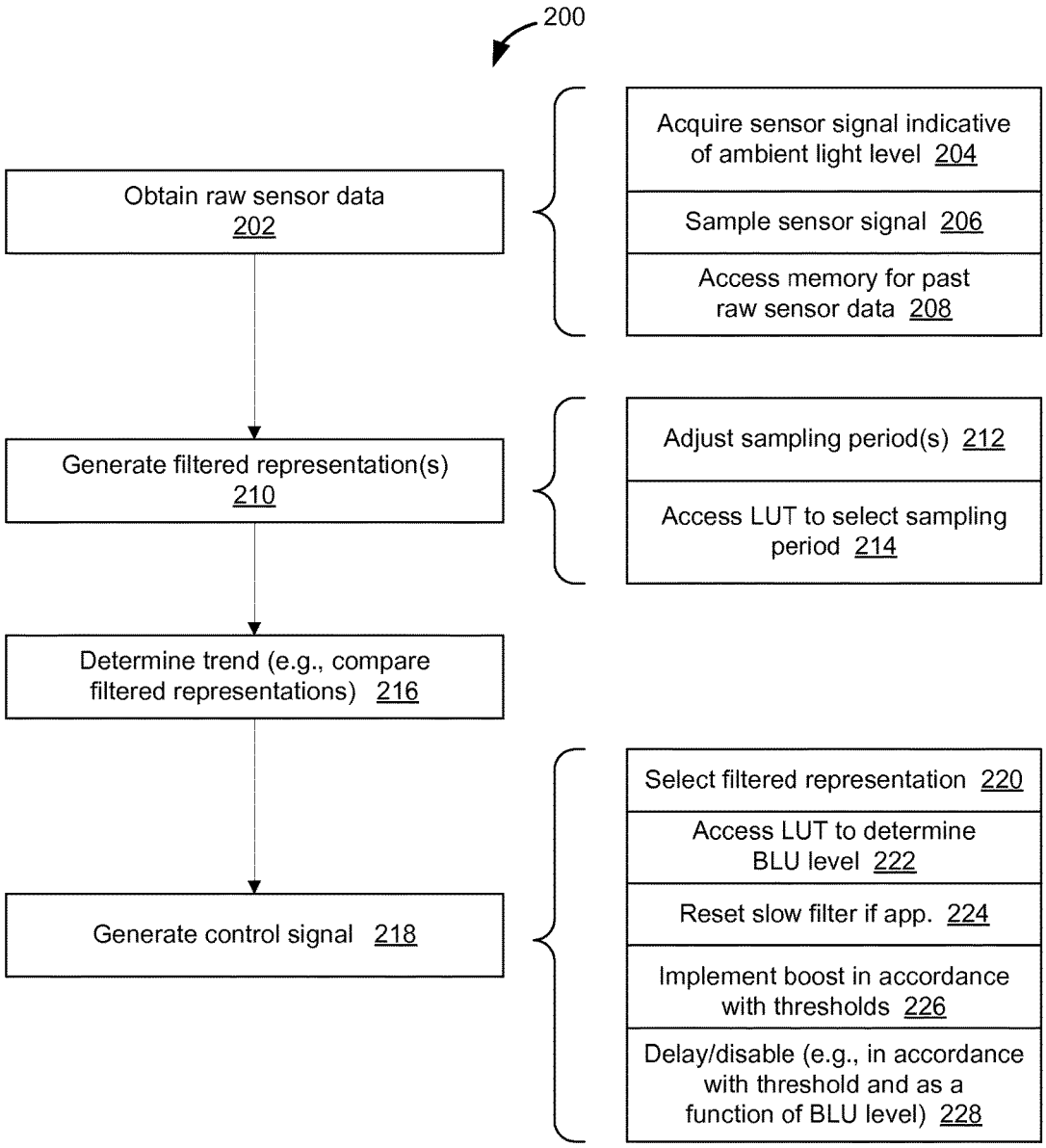
FIG. 2 is a flow diagram of a method of emission unit brightness adjustment in accordance with one example.

FIG. 2 depicts an exemplary method 200 of controlling a backlight unit of a display. The method 200 is computer-implemented. For example, one or more computers of the electronic device 100 shown in FIG. 1 and/or another electronic device may be configured to implement the method or a portion thereof. The implementation of each act may be directed by respective computer-readable instructions executed by the processor 108 (FIG. 1) of the electronic module 102 (FIG. 1), the GPU 112 (FIG. 1) of the electronic module 102, and/or another processor or processing system. Additional, fewer, or alternative acts may be included in the method 200. For example, the method 200 may include a number of acts directed to iterative processing in connection with each incoming sample of a sensor output indicative of an ambient light level. The method may also include acts that direct or otherwise apply a control signal to a backlight unit.

The method 200 may begin with one or more acts related to controlling a light sensor responsive to ambient light level. The light sensor may be directed to capture the ambient light and generate a sensor signal indicative of the ambient light level. Alternatively, the control of the light sensor is handled by a different procedure, method or process.

Sensor data indicative of the ambient light level is obtained in act 202. The sensor data may be raw or unfiltered sensor data. Alternatively, the sensor data may be filtered or processed, e.g., via hardware, such as a component of the light sensor. In some cases, the sensor data is obtained in act 204 by acquiring or receiving a sensor signal from the light sensor. The sensor signal may be analog or digital. In the former case, the sensor signal is sampled in act 206. Alternatively or additionally, past sensor data is obtained in an act 208 by accessing a memory. The past sensor data may be representative of the ambient light level during a previous iteration of the procedure.

In act 210, one or more filtered representations of the ambient light level are generated in accordance with the sensor data. The filtered representations may be generated by respective filters having different sampling periods. For example, a slow filter and a fast filter may be used. The fast filter has a shorter sampling period than the slow filter. A noise filter may also be used to provide a filtered representation that closely tracks the sensor signal. The noise filter may have a shorter sampling period than both the fast and slow filters.

The sampling period of the filter(s) may be adjusted in act 212. For example, the sampling period of the slow and fast filters may be adjusted based on the ambient light level as described above in connection with Table 1. The sampling period may be adjusted before or after the filtered representations are generated. In the former case, the ambient light level from a previous iteration of the procedure may be used. The value of the ambient light level may be provided by one of the filters. In the latter case, the filtered representation generated by the filter (or one of the other filters) may be used to adjust the sampling period for the next iteration. In either case, the filtered representation provided by the noise filter may be used. In still other cases, the sampling period adjustment may be based on the target BLU brightness level rather than one of the filtered representations.

The sampling period adjustment may include accessing a look-up table in act 214. The look-up table may be configured as described above in connection with Table 1. A respective sampling period for each of the slow and fast filters may be selected via the data stored in the look-up table. In other cases, the look-up table may define a function or other data from which the sampling periods may be interpolated or otherwise determined. In still other cases, the sampling period adjustment may be based on information stored in data structures other than a look-up table, such as an instruction set specifying a relationship between the sampling period and one or more of the parameters addressed above.

In act 216, a direction in which the ambient light level is trending is determined. The ambient trend may be determined using a comparison of the filtered representations as described above. Other comparisons may be used, including, for instance, comparisons of filtered representations from successive iterations of the procedure. The ambient trend may thus be determined using one or more of the filtered representations.

A control signal for the BLU unit is generated in act 218. The control signal is generated based on the ambient trend. The control signal increases the BLU brightness level at a rate greater than the rate at which the BLU brightness level is decreased. In some cases, the difference in the adjustment rates may be based on the filtered representations. For example, generating the control signal may include selecting one of the filtered representations in act 220. The BLU brightness level may then be increased in accordance with the filtered representation provided by the fast filter, and then be decreased in accordance with the filtered representation provided by the slow filter. A look-up table may then be accessed in act 222 to determine the BLU brightness level corresponding with the value of the selected filtered representation.

The control signal may be generated in accordance with, or based on, the filtered representation(s) in other ways. For example, the adjustment rates for increasing and decreasing ambient trends may differ by a fixed amount (e.g., 5000 ms) or by a relative amount (e.g., the BLU brightness level increases at twice the rate that the BLU brightness decreases). In such cases, the BLU brightness level may be adjusted at the respective rate until reaching a target BLU brightness level corresponding with the current filtered representation of the ambient light level. Fixed or relative differences in the adjustment rates may be useful in cases in which a single filtered representation is generated in the act 210.

In some cases, the filtered representation of a slow (or slower) filter is reset in act 224. The filtered representation may be reset to the value of one of the other filtered representations, such as a fast (or faster) filter, as described above. Resetting the slow filter may be appropriate when the filtered representation of a fast (or faster) filter is selected for use in generating the control signal.

The generation of the control signal may include one or more departures from the adjustment rates as established by the ambient trend and, in some cases, the ambient light level and/or the BLU brightness level. In the example of FIG. 2, a boost procedure may be implemented in act 226 in accordance with one or more thresholds. The thresholds may include a low ambient light threshold (e.g., the ambient light level is sufficiently low to warrant a higher adjustment rate) and an offset threshold (e.g., the filtered representation used to determine the BLU brightness level is sufficiently offset from another filtered representation, such as that provided by a noise filter).

The example of FIG. 2 includes further possible adjustment rate departures. In act 228, an adjustment may be delayed or disabled in accordance with one or more factors. For example, adjustments may be delayed in conditions in which the BLU brightness level is below a threshold. The delay may introduce hysteresis into the BLU control procedure. Other types of hysteresis or delay may be provided.

The amount of the hysteresis or delay may vary as a function (e.g., linearly) of the BLU brightness level. In linear cases, a hysteresis slope may be established via a look-up table or other data structure. For example, the hysteresis slope may define the delay as falling in a range from about 8 seconds to 0 seconds as the BLU brightness level increases from 0% to 25%. A variety of other levels and delays may be used to customize the extent of the delay. Further details regarding an exemplary delay procedure are described below in connection with FIG. 3.

Adjustments may be delayed or disabled in the act 228 in other conditions. For example, adjustments may be prevented while a touch sensor unit detects the presence of a stylus or pen. Such disabling or prevention may be warranted in other conditions or circumstances. The adjustments may be prevented in connection with the generation of the control signal, as shown in FIG. 2. Alternatively, one or more of the previous acts of the method may also be disabled. For example, the acts 210 and 216 may be disabled upon detection of the stylus.

The order of the acts of the method may vary from the example shown. For example, in some cases, BLU brightness levels may be determined for each filtered representation provided by the slow and fast filters. One of the BLU brightness levels is then selected to generate the control signal.

The method 200 may be repeated for each sample of the sensor signal. For example, the method 200 may be repeated every 100 ms if the reporting interval of the light sensor is 100 ms. Other iteration rates may be used. For instance, each iteration may not correspond with a respective sensor data sample. In one example, the method 200 is repeated every third sample, in which case the three sensor samples may be averaged or otherwise processed before use by the method 200.

Figure 3:
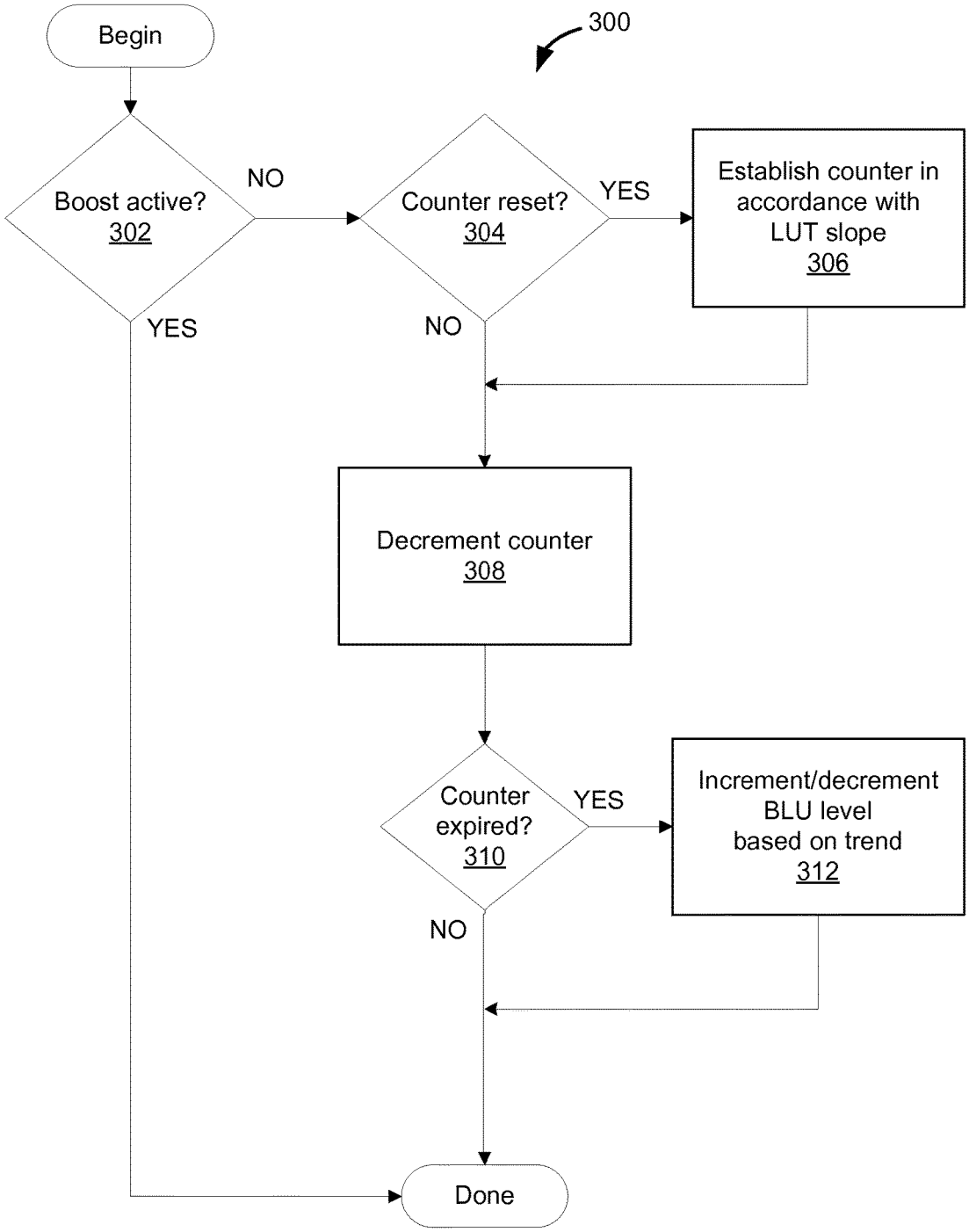
FIG. 3 is a flow diagram of a hysteresis delay procedure of the method of FIG. 1 in accordance with one example.

FIG. 3 depicts one example of a method 300 that implements a hysteresis delay procedure. In some cases, the method 300 begins with a decision block 302 that determines whether a boost procedure is applicable or active. In this example, if the boost procedure is active during the present iteration, then the hysteresis delay procedure is bypassed as shown. If the boost procedure is inactive, then control passes to another decision block 304 in which the state of a counter is determined. If the counter is reset or initialized, then the control passes to an act 306 to establish the extent (or length) of the hysteresis delay.

In the example of FIG. 3, the length of the hysteresis delay is established by establishing a counter. The counter may be countdown timer. The value of the counter may be established in accordance with (e.g., as a function of) the present BLU brightness level (and/or ambient light level). The function may be a linear function. The value of the counter may be established via a look-up table and/or via the function. For instance, in a linear function example with a maximum delay of 8 seconds (8000 ms) at 0% BLU brightness and 0 seconds at 25% BLU brightness, the delay is 4 seconds (4000 ms)—or 40 samples) at 12.5% BLU brightness.

After the counter is established (or recognized as previously established), the counter is decremented in act 308. For example, the 40 sample counter is decremented from 40 to 39. In other examples, the counter may incremented or otherwise updated.

A decision block 310 then determines whether the counter has expired. If not, the method 300 ends without any adjustments to the BLU brightness level. Termination of the method 300 may return control to the control procedure that initiated the method 300, such as the procedure of the method 200 of FIG. 2. If the counter has expired (e.g., the 40 sample counter has been decremented to a value of 0), control passes to act 312, in which the BLU brightness level is adjusted. In the example of FIG. 3, the adjustment is limited to an increment or decrement of the BLU brightness level. The BLU brightness level is incremented if the ambient trend is positive. The BLU brightness level is decremented if the ambient trend is negative. For instance, the increment or decrement may be an integer adjustment (e.g., +1% or −1%) or other adjustment (e.g., a maximum adjustment of 2%).

The act 312 may include resetting the counter to a default or other initial value. The default initial value may be used as an indication that the value of the counter is to be configured and initiated upon the next execution of the method 300. The decision block 304 is then configured to detect the default initial value, in which control passes to the act 306 to establish the counter. The act 306 may then change the counter from the default initial value to the correct initial value (e.g., in accordance with the linear function (slope) or other function or relationship, as described above). In other cases, the value of the counter remains at zero, and the decision block 304 is configured to detect the zero value to cause the act 306 to configure and initiate the counter.

The hysteresis delay may differ from the example of FIG. 3 in various ways. In one example, the BLU brightness level is adjusted, upon expiration of the counter, to the level corresponding with the current value of the applicable filtered representation. Alternatively, such immediate adjustment is implemented only in conditions in which the ambient trend is increasing. The adjustment instead involves an integer or other decrement when the ambient trend is decreasing.

With reference again to FIG. 1, the electronic device 100 may be configured as one of a wide variety of computing devices, including, but not limited to, handheld or wearable computing devices (e.g., tablets and watches), communication devices (e.g., phones), laptop or other mobile computers, personal computers (PCs), server computers, set top boxes, programmable consumer electronics, network PCs, minicomputers, mainframe computers, audio or video media players, and other devices. The device 600 may also be configured as an electronic display device, such as a computer monitor, a television, or other display or visual output device.

The memory (or memories) 110 may be or include a buffer, cache, RAM, removable media, hard drive, magnetic, optical, database, or other now known or later developed memory. The memory (or memories) 110 may be a single storage device or computer-readable storage medium, or a group of multiple devices or computer-readable storage media. In some cases, the memory (or memories) 110 may be or include the firmware 114.

The electronics module 102 has sufficient computational capability and system memory to enable basic computational operations. In this example, the computing environment is supported by the CPU or processor 108, which may include one or more processing unit(s) (e.g., standalone processors or integrated processor cores), which may be individually or collectively referred to herein as a processor. The processor 108 and/or the GPU 112 may include integrated memory and/or be in communication with system memory (or memories) 110. The processor 108 and/or the GPU 112 may be a specialized microprocessor, such as a digital signal processor (DSP), a very long instruction word (VLIW) processor, or other microcontroller, or may be a general purpose central processing unit (CPU) having one or more processing cores. The processor 108, the GPU 112, one or more of the memories 110, and/or any other components of the electronics module 102 may be packaged or otherwise integrated as a system on a chip (SoC), application-specific integrated circuit (ASIC), or other integrated circuit or system.

The memories 110 may also include a variety of computer readable media for storage of information such as computer-readable or computer-executable instructions, data structures, program modules, or other data. Computer readable media may be any available media and includes both volatile and nonvolatile media, whether provided in removable storage and/or non-removable storage.

Computer readable media may include computer storage media and communication media. Computer storage media may include both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may accessed by the processing units of the electronics module 102.

The backlight control techniques described herein may be implemented in computer-executable instructions, such as program modules, being executed by the processor 108. Program modules include routines, programs, objects, components, data structures, etc., that perform particular tasks or implement particular abstract data types. The techniques described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices.

The techniques may be implemented, in part or in whole, as hardware logic circuits or components, which may or may not include a processor. The hardware logic components may be configured as Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), and/or other hardware logic circuits.

The technology described herein is operational with numerous other general purpose or special purpose computing system environments or configurations. Examples of well-known computing systems, environments, and/or configurations that may be suitable for use with the technology herein include, but are not limited to, personal computers, hand-held or laptop devices, mobile phones or devices, multiprocessor systems, microprocessor-based systems, set top boxes, programmable consumer electronics, network PCs, minicomputers, mainframe computers, distributed computing environments that include any of the above systems or devices, and the like.

The technology herein may be described in the general context of computer-executable instructions, such as program modules, being executed by a computer. Generally, program modules include routines, programs, objects, components, data structures, and so forth that perform particular tasks or implement particular abstract data types. The technology herein may also be practiced in distributed computing environments where tasks are performed by remote processing devices that are linked through a communications network. In a distributed computing environment, program modules may be located in both local and remote computer storage media including memory storage devices.

In one aspect, an electronic device includes a display comprising a backlight unit, a light sensor configured to generate a signal indicative of ambient light level, a memory in which filtering instructions and backlight control instructions are stored, and a processor configured to implement the filtering instructions to generate at least one filtered representation of the ambient light level in accordance with the signal. The processor is further configured to implement the backlight control instructions to determine whether the ambient light level is increasing or decreasing, and to generate a control signal that, based on the at least one filtered representation, increases a brightness level of the backlight unit at a first rate if the ambient light level is increasing and that decreases the brightness level at a second rate if the ambient light level is decreasing. The first rate is greater than the second rate.

In another aspect, an electronic device includes a display comprising a backlight unit, a light sensor configured to generate a signal indicative of ambient light level, a memory in which filtering instructions and backlight control instructions are stored, and a processor configured to implement the filtering instructions to generate first and second filtered representations of the ambient light level in accordance with the signal, the first and second filtered representations using first and second sampling periods, respectively, the first sampling period being shorter than the second sampling period. The processor is further configured to implement the backlight control instructions to determine a direction in which the ambient light level is trending, and to generate a control signal that, based on the direction, increases a brightness level of the backlight unit in accordance with the first filtered representation or decreases the brightness level in accordance with the second filtered representation.

In yet another aspect, a method of controlling a backlight unit of a display includes obtaining sensor data acquired by a light sensor responsive to ambient light level, generating first and second filtered representations of the ambient light level in accordance with the sensor data, the first and second filtered representations using first and second sampling periods, respectively, the first sampling period being shorter than the second sampling period, determining a direction in which the ambient light level is trending, and generating a control signal that, based on the direction in which the ambient light level is trending, increases a brightness level of the backlight unit in accordance with the first filtered representation or decreases the brightness level in accordance with the second filtered representation.

In connection with any one of the aforementioned aspects, the electronic device or method may alternatively or additionally include any combination of one or more of the following aspects or features. The at least one filtered representation is one of first and second filtered representations of the ambient light level that the processor is directed to generate by the filtering instructions in accordance with the signal. The first and second filtered representations are based on respective filters defined via the filtering instructions. The first and second rates are based on the first and second filtered representations, respectively. The respective filters for the first and second filtered representations have first and second sampling periods, respectively. The first sampling period is shorter than the second sampling period. The emission control instructions direct the processor to generate the control signal such that the brightness level increases in accordance with the first filtered representation if the ambient light level is increasing and such that the brightness level decreases in accordance with the second filtered representation if the ambient light level is decreasing. The filtering instructions direct the processor to reset the second filtered representation based on the first filtered representation if the ambient light level is increasing. The emission control instructions direct the processor to determine whether the ambient light level is increasing or decreasing based on a comparison of the first and second filtered representations. The filtering instructions direct the processor to adjust the first and second rates based on the ambient light level. The filtering instructions define first and second sets of rates for the first and second rates, respectively. The filtering instructions direct the processor to select a respective rate from the first set or the second set based on the ambient light level. The filtering instructions direct the processor to generate a noise-filtered representation of the ambient light level in accordance with the signal. The noise-filtered representation is more responsive to changes in the ambient light level than the at least one filtered representation. The emission control instructions direct the processor to boost the first rate if the brightness level is below a threshold level and if a difference between the noise-filtered representation and the at least one filtered representation exceeds a threshold. The emission control instructions direct the processor to boost the first rate by increasing the at least one filtered representation with each iterative implementation of the emission control instructions. The emission control instructions direct the processor to delay a change in the brightness level if the brightness level is below a threshold level. An extent to which the change is delayed is a function of the brightness level. The display further includes a touch sensor unit. The emission control instructions direct the processor to prevent a change in the brightness level if a stylus is detected by the touch sensor unit. The emission control instructions direct the processor to increase the brightness level in accordance with the first filtered representation if the direction is positive and to decrease the brightness level in accordance with the second filtered representation if the direction is negative. The filtering instructions direct the processor to determine whether the direction based on a comparison of the first and second filtered representations. The filtering instructions direct the processor to adjust the first and second sampling periods based on the ambient light level. The filtering instructions direct the processor to generate a noise-filtered representation of the ambient light level in accordance with the signal. The noise-filtered representation is more responsive to changes in the ambient light level than the first and second filtered representations. The emission control instructions direct the processor to boost the first filtered representation with each iterative implementation of the emission control instructions if the brightness level is below a threshold level and if a difference between the noise-filtered representation and the first filtered representation exceeds a threshold.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

What is claimed is:

1. An electronic device comprising:

a display comprising an emission unit;

a light sensor configured to generate a signal indicative of ambient light level;

a memory in which filtering instructions and emission control instructions are stored; and a processor configured to implement the filtering instructions to generate first and second filtered representations of the ambient light level in accordance with the signal, the first and second filtered representations being based on respective filters defined via the filtering instructions;

wherein the processor is further configured to implement the emission control instructions to determine whether the ambient light level is increasing or decreasing, and to generate a control signal that increases a brightness level of the emission unit at a first rate if the ambient light level is increasing and that decreases the brightness level at a second rate if the ambient light level is decreasing;

wherein the first rate is greater than the second rate;

wherein the first and second rates are based on the first and second filtered representations, respectively; and wherein the respective filters for the first and second filtered representations have first and second sampling periods, respectively, the first sampling period being shorter than the second sampling period.

2. The electronic device of claim 1, wherein the emission control instructions direct the processor to generate the control signal such that the brightness level increases in accordance with the first filtered representation if the ambient light level is increasing and such that the brightness level decreases in accordance with the second filtered representation if the ambient light level is decreasing.

3. The electronic device of claim 1, wherein the filtering instructions direct the processor to reset the second filtered representation based on the first filtered representation if the ambient light level is increasing.

4. The electronic device of claim 1, wherein the emission control instructions direct the processor to determine whether the ambient light level is increasing or decreasing based on a comparison of the first and second filtered representations.

5. The electronic device of claim 1, wherein the filtering instructions direct the processor to adjust the first and second rates based on the ambient light level.

6. The electronic device of claim 1, wherein:

the filtering instructions define first and second sets of rates for the first and second rates, respectively; and the filtering instructions direct the processor to select a respective rate from the first set or the second set based on the ambient light level.

7. An electronic device comprising:

a display comprising an emission unit;

a light sensor configured to generate a signal indicative of ambient light level;

a memory in which filtering instructions and emission control instructions are stored; and a processor configured to implement the filtering instructions to generate at least one filtered representation of the ambient light level in accordance with the signal;

wherein the processor is further configured to implement the emission control instructions to determine whether the ambient light level is increasing or decreasing, and to generate a control signal that, based on the at least one filtered representation, increases a brightness level of the emission unit at a first rate if the ambient light level is increasing and that decreases the brightness level at a second rate if the ambient light level is decreasing; and wherein the first rate is greater than the second rate; and wherein:

the filtering instructions direct the processor to generate a noise-filtered representation of the ambient light level in accordance with the signal, wherein the noise-filtered representation is more responsive to changes in the ambient light level than the at least one filtered representation; and the emission control instructions direct the processor to boost the first rate if the brightness level is below a threshold level and if a difference between the noise-filtered representation and the at least one filtered representation exceeds a threshold.

8. The electronic device of claim 7, wherein the emission control instructions direct the processor to boost the first rate by increasing the at least one filtered representation with each iterative implementation of the emission control instructions.

9. An electronic device of comprising:

a display comprising an emission unit;

a light sensor configured to generate a signal indicative of ambient light level;

a memory in which filtering instructions and emission control instructions are stored; and a processor configured to implement the filtering instructions to generate at least one filtered representation of the ambient light level in accordance with the signal;

wherein the processor is further configured to implement the emission control instructions to determine whether the ambient light level is increasing or decreasing, and to generate a control signal that, based on the at least one filtered representation, increases a brightness level of the emission unit at a first rate if the ambient light level is increasing and that decreases the brightness level at a second rate if the ambient light level is decreasing; and wherein the first rate is greater than the second rate; and wherein the emission control instructions direct the processor to delay a change in the brightness level if the brightness level is below a threshold level.

10. The electronic device of claim 9, wherein an extent to which the change is delayed is a function of the brightness level.

11. An electronic device comprising:

a display comprising an emission unit;

a light sensor configured to generate a signal indicative of ambient light level;

a memory in which filtering instructions and emission control instructions are stored; and a processor configured to implement the filtering instructions to generate at least one filtered representation of the ambient light level in accordance with the signal;

wherein the processor is further configured to implement the emission control instructions to determine whether the ambient light level is increasing or decreasing, and to generate a control signal that, based on the at least one filtered representation, increases a brightness level of the emission unit at a first rate if the ambient light level is increasing and that decreases the brightness level at a second rate if the ambient light level is decreasing; and wherein the first rate is greater than the second rate; and wherein:

the display further comprises a touch sensor unit; and the emission control instructions direct the processor to prevent a change in the brightness level if a stylus is detected by the touch sensor unit.

12. An electronic device comprising:

a display comprising an emission unit;

a light sensor configured to generate a signal indicative of ambient light level;

a memory in which filtering instructions and emission control instructions are stored; and a processor configured to implement the filtering instructions to generate first and second filtered representations of the ambient light level in accordance with the signal, the first and second filtered representations using first and second sampling periods, respectively, the first sampling period being shorter than the second sampling period;

wherein the processor is further configured to implement the emission control instructions to determine a direction in which the ambient light level is trending, and to generate a control signal that, based on the direction, increases a brightness level of the emission unit in accordance with the first filtered representation or decreases the brightness level in accordance with the second filtered representation.

13. The electronic device of claim 12, wherein the emission control instructions direct the processor to increase the brightness level in accordance with the first filtered representation if the direction is positive and to decrease the brightness level in accordance with the second filtered representation if the direction is negative.

14. The electronic device of claim 12, wherein the filtering instructions direct the processor to determine the direction based on a comparison of the first and second filtered representations.

15. The electronic device of claim 12, wherein the filtering instructions direct the processor to adjust the first and second sampling periods based on the ambient light level.

16. The electronic device of claim 12, wherein:

the filtering instructions direct the processor to generate a noise-filtered representation of the ambient light level in accordance with the signal, wherein the noise-filtered representation is more responsive to changes in the ambient light level than the first and second filtered representations;

the emission control instructions direct the processor to boost the first filtered representation with each iterative implementation of the emission control instructions if the brightness level is below a threshold level and if a difference between the noise-filtered representation and the first filtered representation exceeds a threshold.

17. A method of controlling an emission unit of a display, the method comprising:

obtaining sensor data acquired by a light sensor responsive to ambient light level;

generating first and second filtered representations of the ambient light level in accordance with the sensor data, the first and second filtered representations using first and second sampling periods, respectively, the first sampling period being shorter than the second sampling period;

determining a direction in which the ambient light level is trending; and generating a control signal that, based on the direction in which the ambient light level is trending, increases a brightness level of the emission unit in accordance with the first filtered representation or decreases the brightness level in accordance with the second filtered representation.

18. The method of claim 17, further comprising delaying a change in the brightness level if the brightness level is below a threshold level.

19. The method of claim 17, further comprising preventing a change in the brightness level if a stylus is detected by a touch sensor unit.

20. The method of claim 17, further comprising:

generating a noise-filtered representation of the ambient light level in accordance with the signal; and boosting the first filtered representation if the brightness level is below a threshold level and if a difference between the noise-filtered representation and the first filtered representation exceeds a threshold.

* * * * *